United States Patent [19]

Yoshimi

[11] Patent Number: 4,673,273

[45] Date of Patent: Jun. 16, 1987

[54] PROCESSING APPARATUS FOR PHOTOSENSITIVE MATERIAL

[75] Inventor: Yasuhito Yoshimi, Mukoh, Japan

[73] Assignee: Dainippon Screen Mfg. Co., Ltd., Kyoto, Japan

[21] Appl. No.: 828,732

[22] Filed: Feb. 12, 1986

[30] Foreign Application Priority Data

Jul. 12, 1985 [JP] Japan ..... 60-107450[U]

[51] Int. Cl.[4] ..... G03D 3/13

[52] U.S. Cl. ..... 354/322; 354/321

[58] Field of Search ..... 354/319, 320, 321, 322, 354/338, 339

[56] References Cited

U.S. PATENT DOCUMENTS 3,415,176 12/1968 Calder et al. ..... 354/339
4,086,607 4/1978 Muller ..... 354/322
4,367,030 1/1983 Raymond ..... 354/322

FOREIGN PATENT DOCUMENTS 1182589 2/1970 United Kingdom ..... 354/339

*Primary Examiner*—A. A. Mathews
*Attorney, Agent, or Firm*—Lowe Price Leblanc Becker & Shur

[57] ABSTRACT

In a processing apparatus for photosensitive material, comprising a plurality of processing baths arranged in a series-connected fashion, through which the photosensitive material is continuously and sequentially passed for processing the photosensitive material, there is provided at least one droplet guide member arranged above at least one of the processing baths in face-to-face relationship therewith. The droplet guide member has a surface region facing towards such one of the processing baths, which surface region is generally corrugated so as to have a series of alternating ridges and grooves.

1 Claim, 4 Drawing Figures

PROCESSING APPARATUS FOR PHOTOSENSITIVE MATERIAL

BACKGROUND OF THE INVENTION

The present invention relates generally to the treatment of a photosensitive material such as, for example, a continuous strip of photographic film, paper or plate and, more particularly, to a processing apparatus for the photosensitive material of a type including, for example, a developing bath, a fixing bath and a washing or rinsing bath through which the photosensitive material is continuously passed for the photographic treatment thereof.

When it comes to the processing of a photographic material, for example, a continuous strip of photographic film, it is a general practice that the temperature of each of the processing solutions used in the processing apparatus is controlled to a respective predetermined temperature at all times during the processing of the photographic film. By way of example, in the case of the developing and fixing solutions, the temperature to which each of them is controlled is relatively high, for example, 30 to 40° C.

On the other hand, the prior art processing apparatus particularly suited for the treatment of the photographic film is known as comprising a developing bath, a fixing bath, a rinsing bath and a drying unit all arranged in a series-connected fashion within a single housing structure which has a top covering closing the top of the assembly of developing, fixing and rinsing baths to keep their respective interiors dark. The housing structure has an inlet adjacent the developing bath and an outlet adjacent the drying unit, and the continuous strip of already exposed photographic film is continuously passed through the processing apparatus from the inlet towards the outlet, with portions of the film successively immersed in the developing, fixing and rinsing baths while sequentially travelling therethrough. The apparatus has a cross-over area between neighbouring baths, which cross-over area is generally defined by the top of a partition wall separating one processing bath from the next adjacent processing bath.

In the prior art processing apparatus, and in view of the processing solutions being relatively high in temperature as hereinbefore described, it is not unusual that vapor generated from the processing solutions is suspended in a space between the top covering and each processing bath, which vapor is subsequently transformed by condensation into liquid droplets in-contact with the top covering. Those droplets when having grown big fall by gravity into the processing baths and, also, onto the cross-over areas.

Since the vapor and, hence, the droplets generally contain constituents of the respective processing solutions contained in the developing and fixing baths, a problem arises when the droplets containing constituents of the fixing solution fall by gravity into the developing bath to mix with the developing solution, while the entry of the droplets into the fixing bath to mix with the fixing solution in a similar manner may not be considered so much a problem as the entry of the droplets into the developing bath.

As is well known to those skilled in the art of photography, the developing and fixing solutions are highly alkaline and acidic, respectively, and so are the droplets containing the constituents of the developing and fixing solutions, respectively. The entry of the acidic droplets into the developing bath results in the accelerated aging or 'fatigue' of the developing solution by a phenomenon well known to those skilled in the art.

Moreover, when some droplets tending to fall by gravity onto the cross-over areas fall onto portions of the film being processed which are travelling over such cross-over areas from one processing bath to the next adjacent processing bath, the processed, or developed, film has some frames blotched with marks of the droplets. This is particularly true where the droplets fall onto that portion of the film which travels over the cross-over area between the developing and fixing baths, and should therefore be avoided for the film to be processed, i.e., developed, with no developing fault.

In an attempt to minimize the above discussed problems, the inner surface of the top covering which confronts the baths therebelow is coated with a layer of heat insulating material of an open-celled structure, one of the opppsite surfaces of the heat insulating layer remote from the top covering being formed with minute indentations, such as disclosed in, for example, the Japanese Utility Model Publication No. 59-26356 published in 1984.

However, it has been found that the prior art processing apparatus disclosed in the above mentioned Japanese publication still has a shortcoming in that the condensation of the vapor suspended in the space between the baths and the top covering cannot be completely avoided consequently particularly when the operation of the processing apparatus is interrupted for an unreasonably long time and/or when the difference is great between the ambient temperature and the temperature inside the processing apparatus as a whole, liquid droplets are formed by condensation of the vapor of the developing and fixing solutions. Thus, even the prior art processing apparatus disclosed in the above mentioned Japanese publication has such problems.

The above mentioned Japanese publication also discloses the use of a ventilating system having a ventilating duct disposed so as to extend outwardly from the top covering, which system is operated during the operation of the processing apparatus and also for a predetermined time after the processing apparatus has been interrupted or brought to a halt, for exhausting the vapor suspended inside the processing apparatus. Although the use of the ventilating system is effective to minimize the possibility of condensation of the vapor inside the processing apparatus, it causes the processing apparatus as a whole to be bulky and complicated in structure. In view of this, the processing apparatus according to the above mentioned Japanese publication is not suited for the manufacture to a table-top model.

The inventors of the present invention have devised, as disclosed in Japanese Utility Model Application No. 59-126804 (corresponding to the copending U.S. patent application Ser. No. 730,800, filed May 6, 1985, now abandoned), a processing apparatus for photosensitive material wherein droplet guide members are disposed above the processing baths so as to extend downwardly at a predetermined angle of inclination towards such respective positions, for example, centers of the surface levels of the processing solutions, where no practical problems occurs even if the droplets resulting from the condensation of the vapor fall into the processing baths.

Although this prior processing apparatus disclosed and claimed in the copending U.S. application is effective to substantially eliminate the previously discussed problems, it is believed to have room for further improvement. More specifically, where the angle of inclination of the droplet guide members can not be made sufficiently great because of the limited availability of a space above the processing baths, some of the droplets tend to remain sticking to undersurfaces of the droplet guide members and some of them tend to move towards the lower ends of the droplet guide members while travelling in a zig-zag fashion, and it often occurs that some of the droplets may fall by gravity from the undersurfaces of the droplet guide members before they reach the lower ends thereof.

SUMMARY OF THE INVENTION

The present invention is an improvement over the prior processing apparatus disclosed and claimed in the copending U.S. application referred to hereinbefore, and has for its essential object to provide an improved processing apparatus which can be manufactured to be compact in size and less complicated in structure.

In order to accomplish the above described object, the present invention provides the processing apparatus with at least one droplet guide member positioned above at least one processing bath in face-to-face fashion therewith, said guide member having an operative surface confronting the processing bath and substantially corrugated so as to provide a series of alternating ridges and grooves extending in a direction in which the guide member protrudes.

With the processing apparatus according to the present invention, the undesirable droplets formed by condensation of the vapor generated from the processing bath are first collected at the ridges of the droplet guide member and, after having subsequently flowed down the respective downwardly oriented ridgelines of the ridges towards their lower ends, are forced to fall downwards by gravity into the processing bath positioned immediately below the lower ends thereof. At this time, since the droplets collected at the ridges of the droplet guide member and the operating surface of the droplet guide member are in line contact with each other, the resistance to the flow of the collected droplets towards the lower ends is minimal and, therefore, the droplets can be positively directed towards the lower ends with no stagnation, falling by gravity into the processing bath.

BRIEF DESCRIPTION OF THE DRAWINGS

This and other objects and features of the present invention will readily be understood from the following detailed description thereof made in connection with preferred forms of embodiment of the present invention with reference to the accompanying drawings in which like parts are designated by like reference numerals throughout the several views, and in which.

DETAILED DESCRIPTION OF THE PREFERRED EMBODIMENTS

Figure 1:
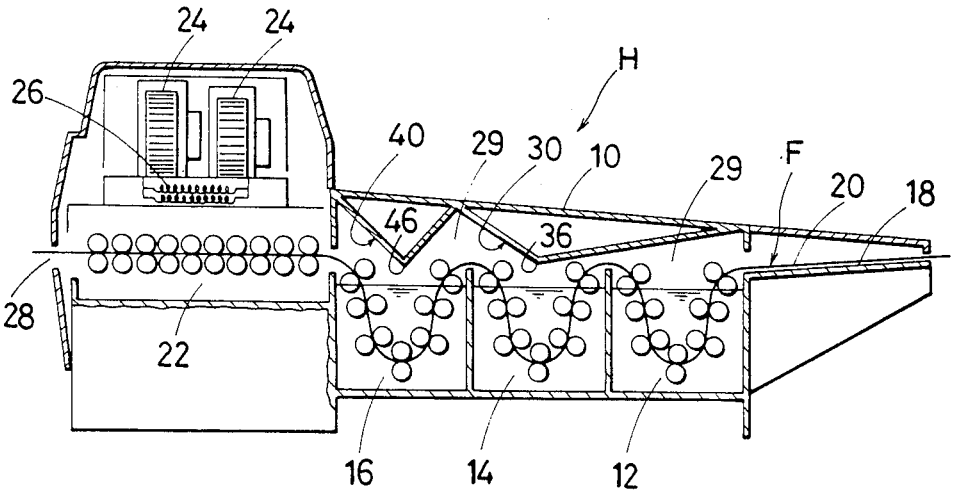
FIG. 1 is a schematic side sectional view of a processing apparatus for photosensitive material according to a first preferred form of embodiment of the present invention.
Figure 2:
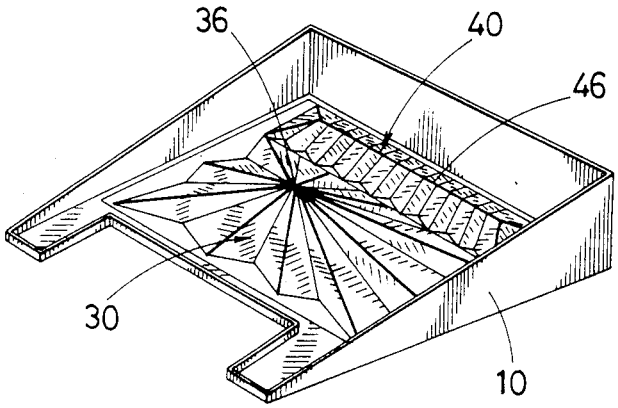
FIG. 2 is a perspective view, on an enlarged scale, of a top covering used in the apparatus shown in FIG. 1, showing an operative surface thereof with the top covering reversed.

Referring first to FIGS. 1 and 2, there is schematically illustrated a processing apparatus suited for processing a continuous strip of photographic film identified by F. The processing apparatus comprises a generally elongated housing structure H having a developing bath 12, a fixing bath 14, a rinsing bath 16 and a drying chamber 22 all defined therein in series-connected fashion in the order specified above. The housing structure H includes a feed-in tray 18 arranged on one side of the developing bath 12 remote from the fixing bath 14 and providing the entrance to a transport passage, generally identified by 20, that extends from one end to the opposite end of the housing structure H. A portion of the transport passage 20 between the feed-in tray 18 and the entrance to the drying chamber 22 extends in a generally zig-zag fashion and is defined by three sets of paired feed rolls so disposed and so positioned that the strip of film F can be successively immersed first into the developing bath 12, then into the fixing bath 14 and finally into the rinsing bath 16, during the transportation thereof from the feed-in tray 18 towards the drying chamber 22.

Another portion of the transport passage 20 extending within the drying chamber 22 is defined by a plurality of paired feed rolls for transporting the strip of film F towards an outlet opening 28 defined in the housing structure H at one end thereof remote from the feed-in tray 18. Within the drying chamber 22, a hot air flow, produced by blowers 24 and subsequently passed through energized heating elements 26, is circulated to facilitate the drying of the strip of film F being transported through the drying chamber 22.

In the construction so far described, the strip of film F, which has been photographically exposed, is continuously passed through the processing apparatus from the feed-in tray 18 along the transport passage 20, emerging outwardly from the processing apparatus through the outlet opening 28. During the travel of the strip of film F along the transport passage 20, the strip of film F is sequentially developed in the developing bath 12, fixed in the fixing bath 14, rinsed in the rinsing bath 16 and finally dried in the drying chamber 22. As a matter of course, the developing and fixing baths 12 and 14 contain therein respective quantities of developing and fixing solutions well known in the art whereas the rinsing bath 16 may either contain a quantity of water or be circulated with a continuous flush of water.

The housing structure H has a top covering 10 mounted thereon so as to close the top opening of that housing compartment where the developing, fixing and rinsing baths 12, 14 and 16 are defined, so that a space above the developing, fixing and rinsing baths 12, 14, and 16 can be kept dark.

As best shown in FIG. 2, the top covering 10 has an operative surface facing the developing, fixing and rinsing baths 12, 14 and 16, which surface is, for the purpose of the description of the present invention, divided into trailing and leading surface areas positioned immediately above the developing and fixing baths 12 and 14 and the rinsing bath 16, respectively, it being to be noted that the terms "trailing" and "leading" referred to above are in relation to the direction in which the strip of film F is transported from the feed-in tray 18 towards the outlet opening 28. The trailing and leading surface areas of the top covering 10 are provided with first and second droplet guides 30 and 40, the details of each of which will now be described.

The first droplet guide 30 positioned above the developing and fixing baths 12 and 14 is of a shape generally similar to the shape of an inverted pyramid and is comprised of four generally triangular side panels fabricated, or formed by molding, so as to represent the generally inverted pyramid-like shape. Therefore, the first droplet guide 30 has an apex portion 36 oriented downwardly and positioned immediately above the surface level of the fixing solution within the fixing bath 14 as shown in FIG. 1. Each of the triangular side panels of the first droplet guide 30 is corrugated in a fashion similar to a folding fan and, therefore, has a series of alternating ridges and grooves all extending towards, and converging at, the apex portion 36 with the width of each ridge or groove progressively decreasing.

As viewed in FIG. 1, two of the triangular side panels of the first droplet guide 30, which are positioned on the trailing and leading sides with respect to the direction of travel of the strip of film F are downwardly inclined at different angles of inclination, respectively, relative to the trailing surface area of the top covering 10, whereas the remaining triangular side panels thereof, positioned on respective sides of the transport passage 20, are downwardly inclined at the same angles of inclination, respectively, relative to the trailing surface area of the top covering 10. As should be noted that these angles of inclination of the four triangular side panels are selected so as to permit the apex portion 36 to be positioned immediately above the surface level of the fixing solution within the fixing bath 14 and substantially in alignment with the center of the fixing bath 14.

The second droplet guide 40 positioned above the rinsing bath 16 is comprised of a pair of side panels fabricated, or formed by molding, so as to represent a shape similar to the shape of a figure "V" having a ridgeline 46 oriented downwardly towards the rinsing bath 16 and extending in a direction transverse to the direction of travel of the strip of film F. Preferably, the ridgeline 46 of the second droplet guide 40 is positioned intermediate of the width of the rinsing bath 16 as measured in a direction parallel to the direction of travel of the strip of film F. Each of the side panels constituting the second droplet guide 40 is so corrugated as to have a series of alternating ridges and grooves all extending towards the ridgeline 46 as best shown in FIG. 2.

The first and second droplet guides 30 and 40 provided in the top covering 10, as hereinbefore described in accordance with the preferred form of embodiment of the present invention, operate in the following manner.

During the operation of the processing apparatus and even after the processing apparatus has been brought to a halt, the space 29 above the processing baths 12, 14 and 16 are filled with a vapor containing constituents of the processing solutions used in the developing and fixing baths 12 and 14. When this vapor contacts the first and second droplet guides 30 and 40, the vapor condenses to form undesirable droplets sticking to all of the surfaces of the first and second droplet guides 30 and 40 which face downwards. Some of the droplets which are formed on the surfaces of the first droplet guide 30 are collected at the ridges of the first droplet guide 30 and then flow by gravity towards the apex portion 36 without substantial stagnation and also without flowing in a zig-zag manner, finally falling by gravity into the fixing bath 14 positioned immediately therebelow.

Similarly, some of the droplets which are formed on the surface of the second droplet guide 40 are collected at the ridges of the second droplet guide 40 and then flow by gravity towards the ridgeline 46, finally falling by gravity into the rinsing bath 16 positioned immediately therebelow.

Accordingly, there is no substantial possibility that some of the droplets may fall onto a portion of the strip of film F being passed over each of the cross-over areas one between the developing and fixing baths 12 and 14 and the other between the fixing and rinsing baths 14 and 16. In addition, the prevention of the droplets from falling into the developing bath 12 is effective to minimize the premature aging or 'fatigue' of the developing solution such as occurring in the prior art processing apparatus.

In the foregoing description of the first preferred form of embodiment of the present invention, both of the first and second droplet guides 30 and 40 have been described as formed with respective series of alternating ridges and grooves. However, the series of the alternating ridges and grooves may be provided only in the first droplet guide 30 wherein the angle of inclination of the constituent side panels is relatively small as compared with that in the second droplet guide 40.

Figure 3:
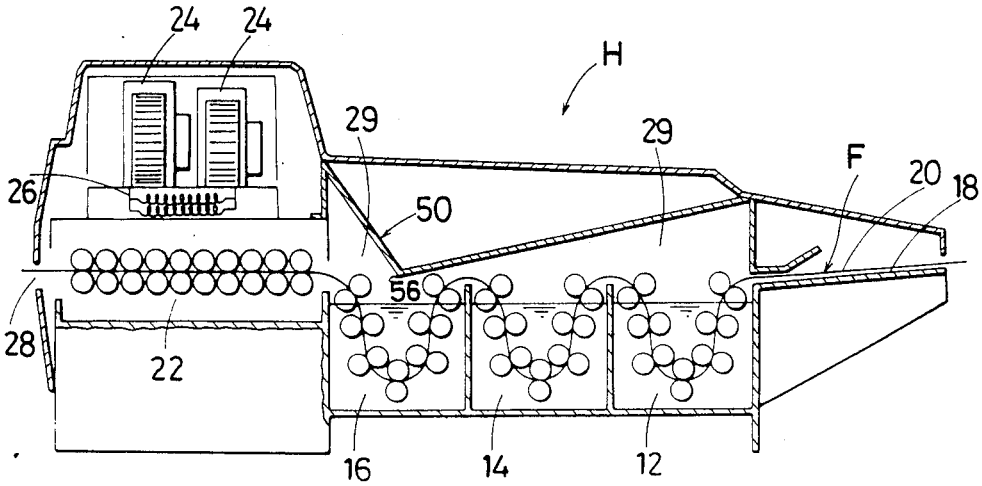
FIGS. 3 and 4 are schematic side sectional views of the processing apparatus according to second and third preferred forms of embodiment of the present invention, respectively.

Instead of the employment of the two droplet guides 30 and 40 described with reference to and shown in FIGS. 1 and 2, a single droplet guide may be employed such as shown generally by 50 in FIG. 3. The droplet guide 50 in the second preferred form of embodiment of the present invention shown in FIG. 3 is of a construction similar to the first droplet guide 30 employed in the apparatus according to the foregoing embodiment of FIGS. 1 and 2 and has an apex area identified by 56. This droplet guide 50 is secured to, or otherwise formed integrally with the top covering 10 with the apex area 56 oriented downwards and confronting the rinsing bath 16.

In the apparatus shown in FIG. 3, however, the droplets are formed on the surfaces of the droplet guide 50, in a manner similar to that described in connection with the first droplet guide 30 used in the foregoing embodiment, and then fall by gravity into the rinsing bath 16 because the apex area 56 is positioned immediately above the rinsing bath 16.

Although not shown, the droplet guide 50 may be alternatively constructed of a structure similar to the second droplet guide 40 employed in the apparatus shown in FIGS. 1 and 2. In this case, the droplet guide has a ridgeline extending in a direction transverse to the direction of travel of the strip of film F as is the case with the second droplet guide 40 in the embodiment of FIGS. 1 and 2.

Figure 4:
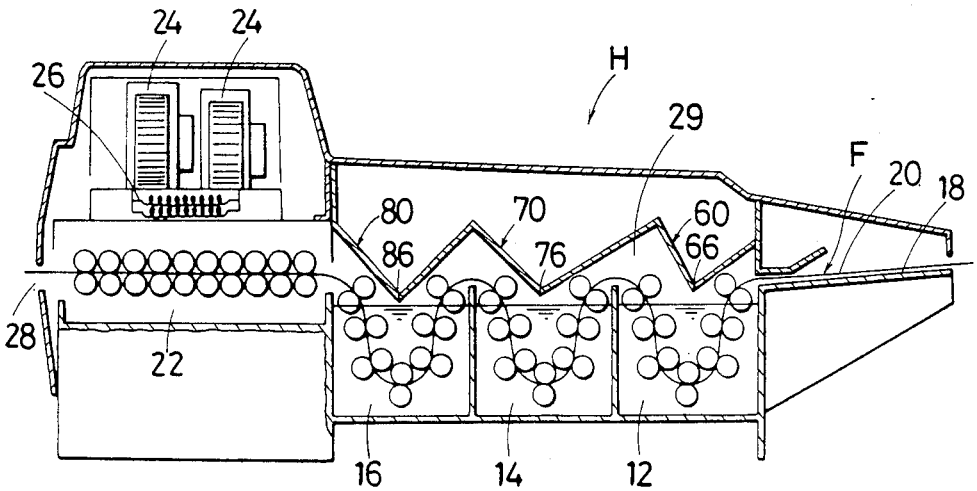

In the third preferred form of embodiment of the present invention shown in FIG. 4, first, second and third droplet guides 60, 70 and 80 are arranged immediately above the developing, fixing and rinsing baths 12, 14 and 16, respectively. Each of the first, second and third droplet guides 60, 70 and 80 may be of a construction similar to either the first droplet guide 30 or the second droplet guide 40 which are employed in the apparatus described with reference to and shown in FIGS. 1 and 2.

Even in the apparatus shown in FIG. 4, the vapors generated from the developing, fixing and rinsing baths 12, 14 and 16 and suspended in the space 29 are condensed in contact with the surfaces of the first, second and third droplet guides 60, 70 and 80 respectively to form droplets which are in turn directed towards respective apex area or ridgelines 66, 76 and 86. The condensed droplets fall by gravity into the associated processing baths 12, 14 and 16 positional immediately therebelow, with no substantial possibility of their falling onto respective portions of the strip of film F being passed over the cross-over areas between the developing and fixing baths 12 and 14 and between the fixing and rinsing baths 14 and 16.

However, in the apparatus according to the third preferred form of embodiment of the present invention shown in FIG. 4, it may happen that a portion of the vapor generated from one processing bath may form the droplets at the generally corrugated surfaces of the droplet guide positioned above the next adjacent processing bath. However, since the second droplet guide above the fixing bath 14 has one of its side panels extending to a position above and partially covering the top of the developing bath 12, the droplet containing the constituents of the fixing solution are directed towards the apex area 76 of the second droplet guide 70 without substantially falling by gravity into the developing bath 12, and accordingly, there is no substantial possibility of the developing solution being prematurely aged.

Although the present invention has been truly described in connection with the preferred forms of embodiment thereof with reference to the accompanying drawings, it is to be noted that various changes and modifications are readily conceivable to those skilled in the art. Such changes and modifications, unless they depart from the true scope of the present invention as defined by the appended claim, are to be understood as included therein.

What is claimed is:

1. In a processing apparatus for photosensitive material comprising a plurality of processing baths including a developing bath, a fixing bath and a washing bath arranged in order, through which the photosensitive material is continuously and sequentially passed for processing said photosensitive material, an improvement which comprises:

at least one condensate droplet guide member arranged above at least one of the processing baths, in face-to-face relationship with at least one of the said processing baths, said droplet guide member having a surface region facing towards at least one of said processing baths and generally corrugated so as to have a series of alternating ridges and grooves inclined relative to a horizontal plane to provide numerous flow paths to guide and prevent said droplets from dropping onto said photosensitive material therebelow, the lowest end of said droplet guide member being located above any one of said processing baths other than the developing bath.

* * * * *